United States Patent [19]

Salomon

[11] 4,258,482

[45] Mar. 31, 1981

[54] SKI BOOT

[75] Inventor: Georges P. J. Salomon, Annecy, France

[73] Assignee: S.A. Etablissements Francois Salomon & Fils, Annecy, France

[21] Appl. No.: 11,705

[22] Filed: Feb. 12, 1979

[30] Foreign Application Priority Data

Feb. 22, 1978 [FR] France ..... 78 05097

[51] Int. Cl.[3] ..... A43B 5/04; A43B 11/00

[52] U.S. Cl. ..... 36/121; 36/51

[58] Field of Search ..... 36/121, 120, 50, 51

[56] References Cited

U.S. PATENT DOCUMENTS

| | | | |
|---|---|---|---|
| 4,043,059 | 8/1977 | Rathmell | 36/121 |
| 4,095,356 | 6/1978 | Robran et al. | 36/121 |

FOREIGN PATENT DOCUMENTS

| | | | |
|---|---|---|---|
| 2371162 | 7/1978 | France | 36/121 |

*Primary Examiner*—Patrick D. Lawson

*Attorney, Agent, or Firm*—Haseltine, Lake & Waters

[57] ABSTRACT

A ski boot comprises an upper, of which the stiffness is adjustable, and a strap surrounding the upper of the boot in the zone advantageously corresponding to the bottom of the leg.

Means are provided to fix the strap on said upper.

The strap comprises at least one zone of elastic deformation located between the said means for fixation on the upper, and means for controlling the deformation advantageously cooperating with the strap at least one either side of said zone of deformation.

26 Claims, 20 Drawing Figures

Fig. 16
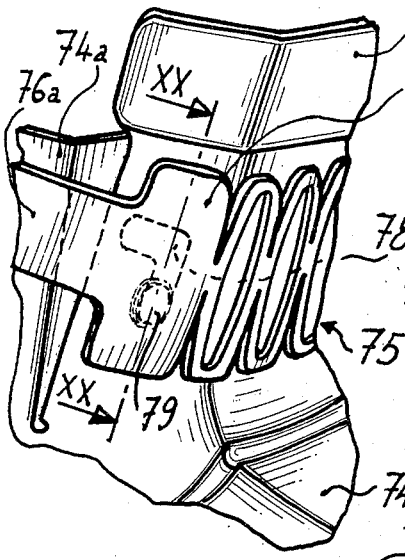
Fig. 17
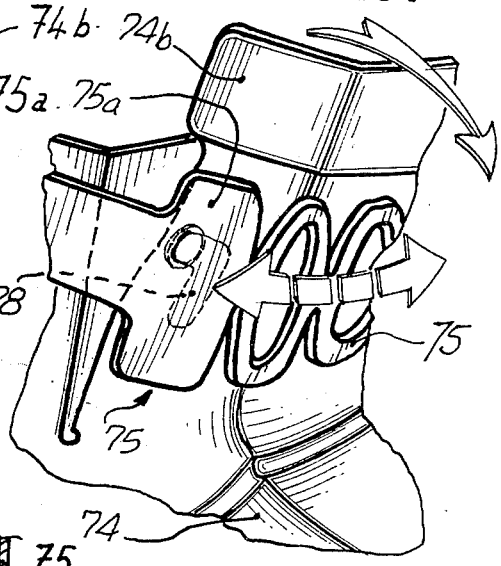
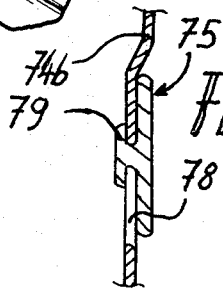
Fig. 20
Fig. 18
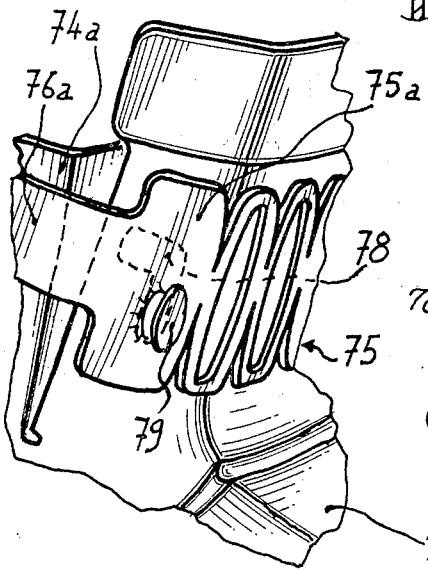
Fig. 19
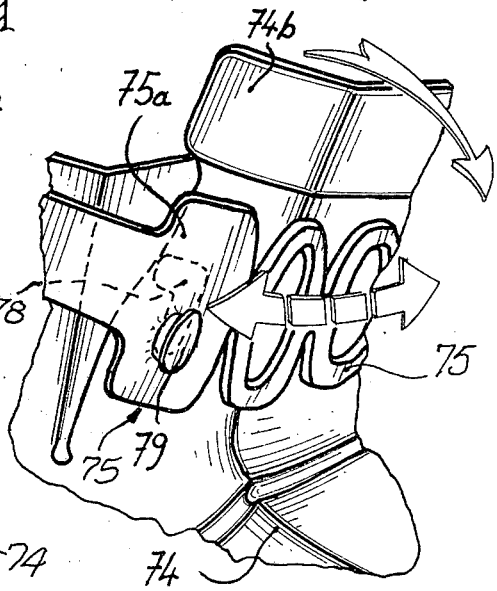

SKI BOOT

BACKGROUND OF THE INVENTION

The present invention relates to improvements in sport shoes and more particularly in ski boots, of which the present modern design causes the upper, surrounding the bottom of the leg, to play an important role in the technique and practice of skiing, where the forward and/or rearward supports for the leg are constantly subjected to stress.

Ski boots provided with devices enabling the supports for supporting the skier's legs in the upper of the boot to be adjusted are already known.

In particular, two-parts ski boots exist, of which the upper pivoted on the bottom part of the shell is provided with devices for adjusting the angle of inclination of this upper with respect to the plane of the sole. These devices comprise generally complex mechanisms of which not only the cost price is high, but which also increase the weight of the boot and its outer dimensions, this brings about certain drawbacks when practising skiing and more particularly for high level skiing. Moreover, these different mechanisms are difficult to integrate in the aesthetics of the boot, as they generally project from the outer periphery thereof. Ski boots are also known which are put on from the rear, and which consequently comprise a particular arrangement of the upper pivoted on the bottom part of the shell. In the case of this boot design, U.S. Pat. No. 4,104,811 filed by applicant on Mar. 28, 1977, also discloses a device for adjusting the point of fastening of a strap surrounding the upper of the boot. This strap for adjusting the stiffness and the inclination of the upper with respect to the bottom part of the shell has the drawback, despite the progress which it brings, of not being sufficiently progressive in its deformations when it is subjected to the stresses of the leg during skiing.

Ski boots are also known which comprise elastic bands arranged on the upper of the boot, the function of which is to ensure the tight enveloping of the leg by said upper, in the case of a boot design not having an articulation between the upper and the bottom part of the shell. The role of the elastic band is then limited to ensuring the closure of the boot around the foot, which, without this, would risk not remaining tight for all the positions taken by the leg when practising skiing.

SUMMARY OF THE INVENTION

It is an object of the present invention on the one hand to remedy the drawbacks of the first embodiments mentioned herein-above and on the other hand to obtain a different result from the last version of boot evoked, namely not simply to ensure the tightness of the upper on the bottom of the leg, but to effect a progressive control of the deformation of the strap essentially when the front support is under stress.

To this end, this ski boot, comprising an upper, of which the stiffness is adjustable, and a strap surrounding the upper of the boot in the zone advantageously corresponding to the bottom of the leg, as well as means provided to fix the strap on said upper, is characterised in that the strap comprises at least one zone of elastic deformation located between the said means for fixation on the upper, and means for controlling the deformation advantageously cooperating with the strap at least one either side of said zone of deformation.

According to a preferred embodiment of the invention, the ski boot according to the invention comprises a bottom part of the shell on which an upper, composed of two parts surrounding the leg bottom, is partially pivoted. The front part of the upper, fast with the bottom part of the shell, absorbs the forces due to the front supports of the leg and comprises the device according to the invention. The rear part of the upper or "spoiler," is pivoted on the bottom part of the shell along a transverse axis approximately located at the level of the articulation of the foot, and absorbs the forces due to the rear support of the leg. In position of use, the rear part is pivoted against the bottom of the leg and is maintained in contact therewith due to a strap surrounding the two parts of the upper. This strap makes it possible not only to maintain the boot upper closed on the leg bottom, but it also enables different stiffnesses and/or angles of inclination of said upper, in ski position, to be obtained.

To this end, the strap comprises, in its central part, a zone of deformation with suitable sections to allow a chosen type of elongation, and is embedded in a corresponding recess in the upper. The upper is composed of a material which is much stiffer than that of the strap. In order to guarantee the holding of the strap on the upper, fixing means are arranged laterally on each side of said upper. The strap being in place on the upper in the zone of the leg bottom, the contour of the recess fits with at least one part of the upper edges of the strap located on each side of the zone of deformation.

In this way, the embedding acts as limiter of deformation of the elastic strap which then prevents the upper from inclining forwardly and stiffens it for a given ski position.

The adjustment of the stiffness and/or the inclination of the upper for obtaining a considerable flexibility of the upper in position of front support may be effected, for the same pair of boots, by turning over and/or inverting the straps from one boot to the other. The contour of the recess being constant the shape of the lower edge of the strap, then placed in high position, allows a clearance to be seen, at the top, on either side of the central zone of deformation of this strap. For front support positions, these clearances enable the upper to bend forwards, and when the contour of the recess of the upper comes into contact with the lower edge of the strap then located in high position, they enable the deformation of said strap to be limited along the same principle as for the rigid position.

According to a variant of the preceding embodiment, in which it is the upper itself which acts as strap deformation limiter, it is provided to arrange laterally, on each side of the upper and in addition to the strap fixing means, means for controlling the deformation of the strap. These means for controlling the deformation of the strap are obtained by the cooperation of lugs fast with the upper with L-shaped slots disposed symmetrically in the strap on either side of the zone of deformation. In "rigid" position of the upper (L-shaped slots in normal position), the lugs are located in a vertical arm of each L-shaped slot oriented upwardly. In "flexible" position (L-shaped slots in inverted position), these lugs may move transversely in the horizontal arm of the L then in high position, after the straps have been turned over and inverted from one boot to the other for the same pair of boots.

According to another embodiment of the invention, the elastic strap comprises means for controlling its deformation, arranged solely on said strap. In this embodiment, said control means, acting as deformation limiter, are composed of a supplementary piece or stiffener element independent of the upper. This stiffener is removably anchored in anchoring slots located in the strap on either side of its central zone of deformation. In "rigid" position of the upper, the stiffener, advantageously composed of a supple material but of almost negligible elongation, is placed above the zone of deformation of the strap and is anchored in the anchoring slots, thus maintaining said zone of deformation at the maximum dimension of the stiffener. In "flexible" position of the upper, the stiffener, removable at least one of its ends, is detached from the corresponding anchoring slot, thus releasing the zone of deformation and enabling it to extend within the limit of the mechanical characteristics of the material of the strap, under the action of the forces due to the front supports of the skier's leg in skiing position.

The ski boots according to the first embodiments of the invention are advantageously provided with an upper made of a more rigid material than that of the strap, in order to obtain the support necessary for making the strap deformation limiter. Moreover, it is possible to adapt and combine various types of sections and shapes for the central deformation zone of the strap whatever the embodiment thereof, as long as they allow the chosen type of extension.

BRIEF DESCRIPTION OF THE DRAWINGS

The invention will be more readily understood on reading the following description with reference to the accompanying drawings, in which:

FIGS. 16, 17, 18, 19 are views in perspective, in various positions of use, of another variant of ski boot.

FIG. 20 is a section view taken along the line XX—XX of FIG. 16.

DESCRIPTION OF THE PREFERRED EMBODIMENT

Figure 1:
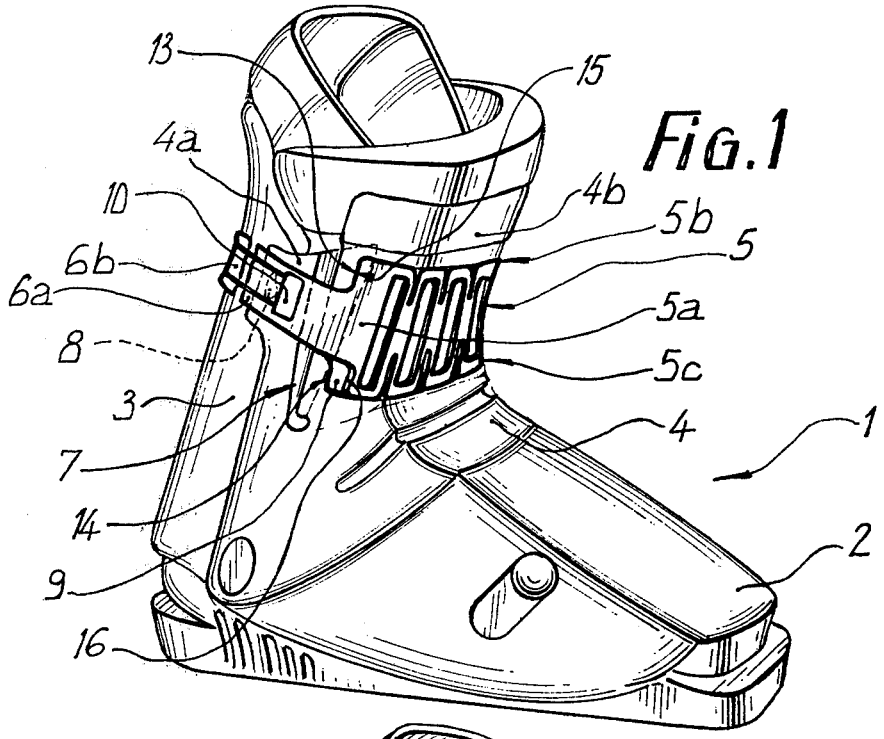
FIGS. 1 to 5 are views in perspective, in various positions of use, of a ski boot according to the invention, in which the deformable strap is embedded in a corresponding recess in the upper, this latter acting as deformation limiter.
Figure 2:
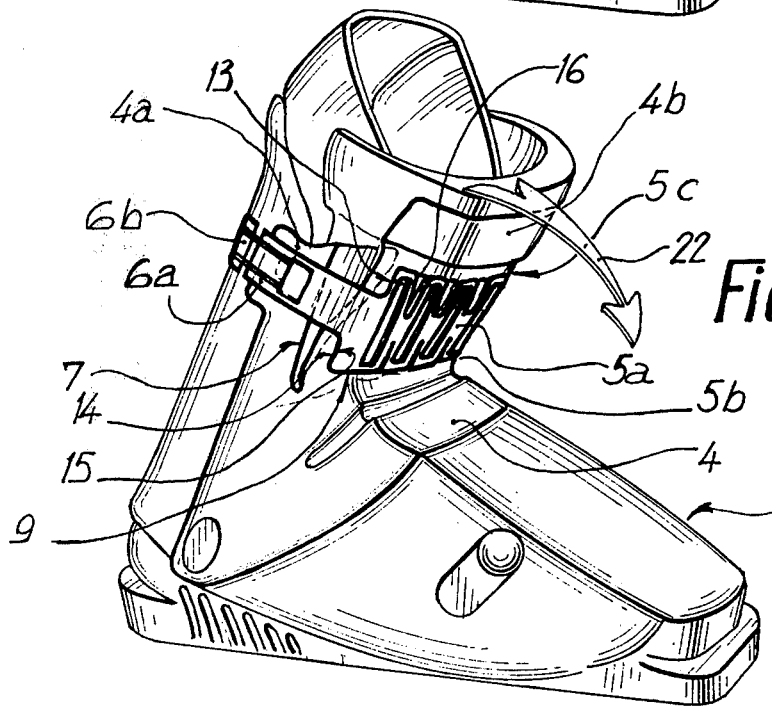

Referring now to the drawings, FIGS. 1 and 2 show a three-part ski boot 1 composed of a bottom part of the shell 2, on the lower and rear part of which are pivoted, about a horizontal and transverse axis, a rear upper or "spoiler" 3 and a front upper 4. A strap 5 is anchored laterally, on each side of the upper 4, in the upper rear parts 4*a* of this upper 4, by means of the schematically shown fixing means 8. These means 8 may advantageously be lugs forcibly engaged and locked in corresponding holes arranged equally well on the strap and/or on the upper. The rear part 6 of the strap ensures the closure of the rigid two-part upper 3–4. In fact, the strap 5, anchored firmly at 8 on the rigid rear parts 4*a* of the upper 4, surrounds the spoiler 3 and maintains it in closed position for skiing due to a closure hook shown schematically at 10, ensuring the rigid connection between the end of the rear part 6 of the strap and its front part 5*a*. The front part 5*a* of the strap surrounds the upper 4 from the lateral anchoring points 8 and is partially housed in a recess 9 made in the front, upper zone of flexion 4*b* of the upper 4 obtained by the arrangement of slits 7, located laterally and on either side of said upper, these slits 7 separating the front flexion zone 4b from the upper rear parts 4*a* of the upper.

In FIG. 1, a right boot is shown in normal static position, the strap 5 being placed in the recess 9, so that its "upper" edge 5b totally fits with the upper contour of said recess.

FIG. 2 shows the same boot, but in position of front flexion (the skier's leg exerting front support stresses is not shown). In this case, the boot is mounted with the strap coming from the left boot so that the so-called "lower" edge edge 5c of said strap is placed in top position, so that this "lower" edge 5*c* partially fits with the upper contour of the recess 9 of the upper 4.

Figure 3:
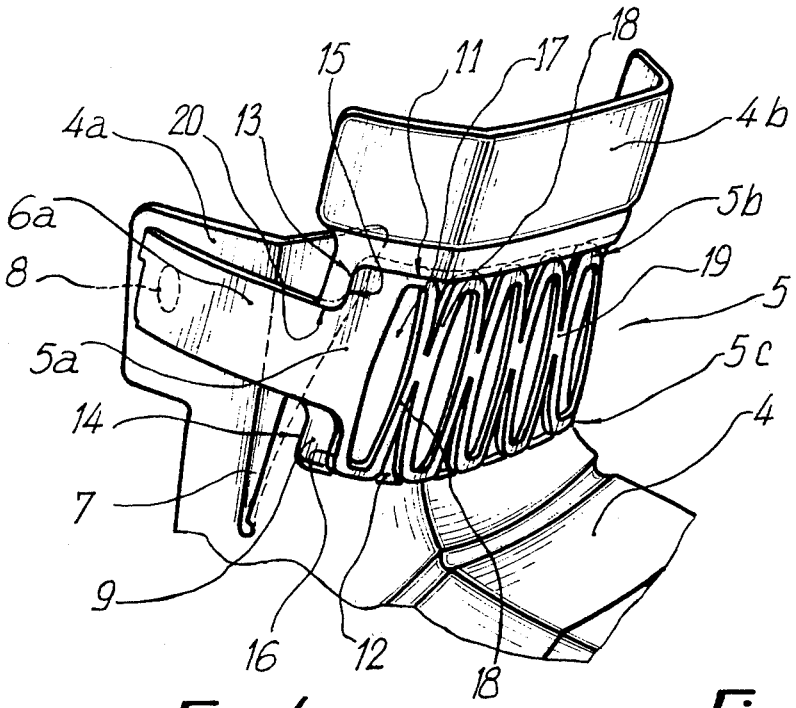
Figure 4:
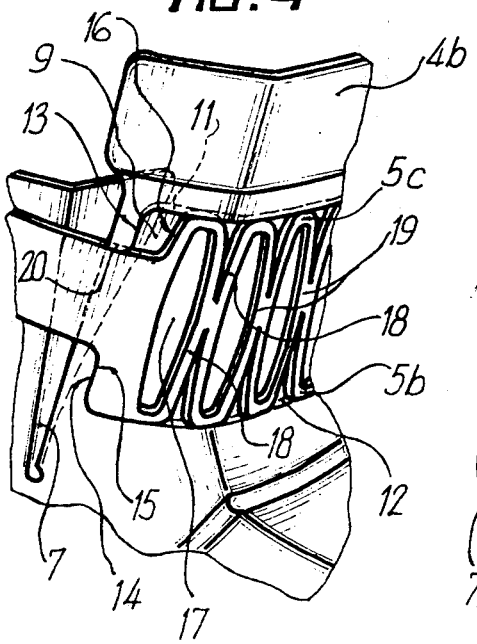
Figure 5:
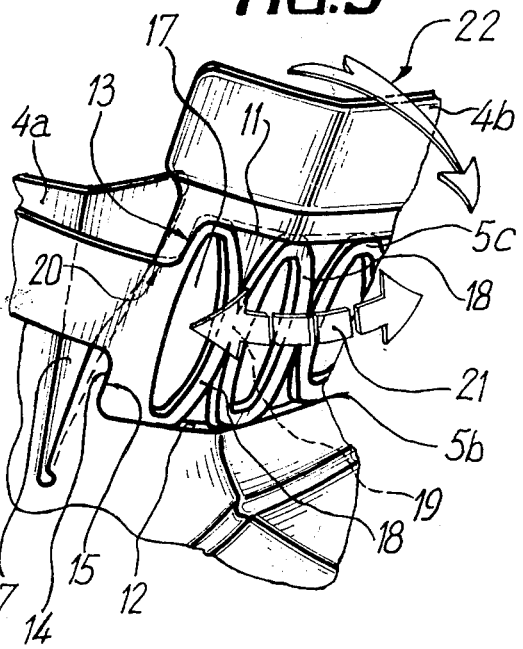

FIGS. 3 to 5 illustrate in detail, on a larger scale, the functioning of the deformable strap according to the invention.

FIG. 3 shows, in normal static position of the boot, the assembling of the strap 5 on the upper 4 and more particularly in the zone of flexion 4b of this upper defined by slits 7. The zone of flexion 4*b* advantageously comprises a recess 9 extending horizontally over this zone and generally rectangular in form. This recess 9 is hollowed in said upper and is defined on the one hand by upper and lower edges 11 and 12, constituting the large sides of the rectangular recess 9 and extending transversely with respect to the longitudinal plane of symmetry of the boot, to block the strap 5 in vertical translation, and on the other hand by upper and lower lateral edges or stops 13 and 14 on each side of the zone of flexion 4*b*, constituting the small sides of the rectangular recess 9 and extending substantially vertically and parallel to the longitudinal plane of symmetry of the boot, to block the strap in transverse translation. An opening 20 is provided laterally and on each side in the thickness of the zone 4*b* of the upper, between the edges 13 and 14, to allow the arms 6*a* and 6*b* of the strap 5 to extend to the rear of the upper and surround same. The strap 5 being housed in the recess 9, the upper edge 5*b* thereof comes into contact with the upper edge 11 of the recess and the lower edge 5*c* comes into contact with the lower edge 12 of this recess, to block in vertical translation, whilst for blocking in transverse translation, only the upper lateral edges 15 of the strap 5 are in contact with the upper lateral edge 13 of the recess 9. In this way, a rigid assembly is obtained between the lateral rear parts 4*a* and the central flexion part 4*b* of the upper, eliminating the effects of the slits 7 and thus ensuring a certain rigidity of the upper even when it is subjected to front flexion stresses (taking into account the mechanical characteristics of the materials used). The flexion zone 4*b* then acts as a stiffener support, and defines a position called "rigid position" of the upper.

The strap 5 is, moreover, arranged to have a central zone 5a adapted to be deformable. The ability to deform is obtained due to particular shapes constituted, as far as the preferred embodiment of the invention is concerned, by oblong rings 17, elongated for example in the vertical sense, connected together by connecting zones 19, located at the centres of sides 18 of each of the adjacent rings. In normal static position of the boot, the lower lateral edges 16 of the strap 5 are each separated by a certain length from the lower lateral edges 14 of the recess 9 of the upper (the strap 5 being mounted in accordance with FIG. 3). It is seen from the preceding that the recess 9 has a length, between its lateral edges, equal to the maximum length of the front part 5*a*, constituting the zone of elastic deformation of the strap 5, in the rest state or not expanded transversely.

Still in normal static position, according to FIG. 4, it appears, after having inverted the straps (from the left boot to the right boot and vice versa), that on the one hand the lateral edges 15 of the strap, previously in top position, are now in low position and fit exactly against the lower lateral edges 14 of the recess 9 of the upper. On the other hand, similarly to the case of the preceding figure, the lateral edges 16 of the strap which were previously in lower position are now in top position, each being separated by a certain length from the upper lateral edges 13 of the recess 9 of the upper.

However, it should be noted that the inversion of the straps with respect to the boots is not an absolutely necessary condition. In fact, it is possible, in the case of a strap covering only the front part of the upper, to simply turn the strap over, for a given boot, either along its longitudinal axis, or along the axis perpendicular to the plane which contains said strap.

The passage from normal static position to the forwardly bent position (under the effect of a a forward flexion due to the efforts of a skier's leg) is effected progressively in the direction of arrow 22 shown in thin lines in FIG. 5.

When the skier exerts his support efforts on the zone of flexion 4*b* of the upper 4, said zone 4*b* separates from the lateral rear parts 4*a* due to the slits 7; at the same time, and more especially the high part of the zone 4*b* acts on the front zone of deformation 5*a* of the strap 5, of which the oblong rings 17 are deformed and stretch transversely with respect to the upper, in the direction of the double broken arrow 21 shown in thin lines. When the oblong rings 17 are deformed in this way, their sides 18 each curve from the zones of connection 19 connecting them so that the large diameter of the oblong rings 15 reduced and their small diameter increased, the rings thus tending to become round and consequently to increase the transverse length of the front zone of deformation 5*a*. Still during this deformation, the edges 5*c* and 5*b* of the strap remain in contact with the upper edge 11 and lower edge 12 of the recess 9, being given that the zone 4*b* continues to bend.

A groove may advantageously be provided (not shown in the figures), which ensures the guiding of the upper and lower ends of the rings 17 which constitute respectively the edges 5*c* and 5*b* moving in translation. The continuation of the movement of flexion is interrupted when the increase, in the transverse length of the front zone 5*a*, is such that it compensates and absorbs the distances between the lateral edges 16 and the upper lateral edges 13 of the recess 9 existing initially in the normal static state of FIG. 4. At this moment, the lateral edges 16 of the front zone of deformation 5*a* abutting with the upper lateral edges 13 of the recess 9, the upper will then reach its extreme bent position. This extreme best position is reached progressively by the deformation of the oblong rings until the zone of deformation comes into abutements with the edges of the recess thus effecting the end of stroke of the upper in flexion.

Figure 6:
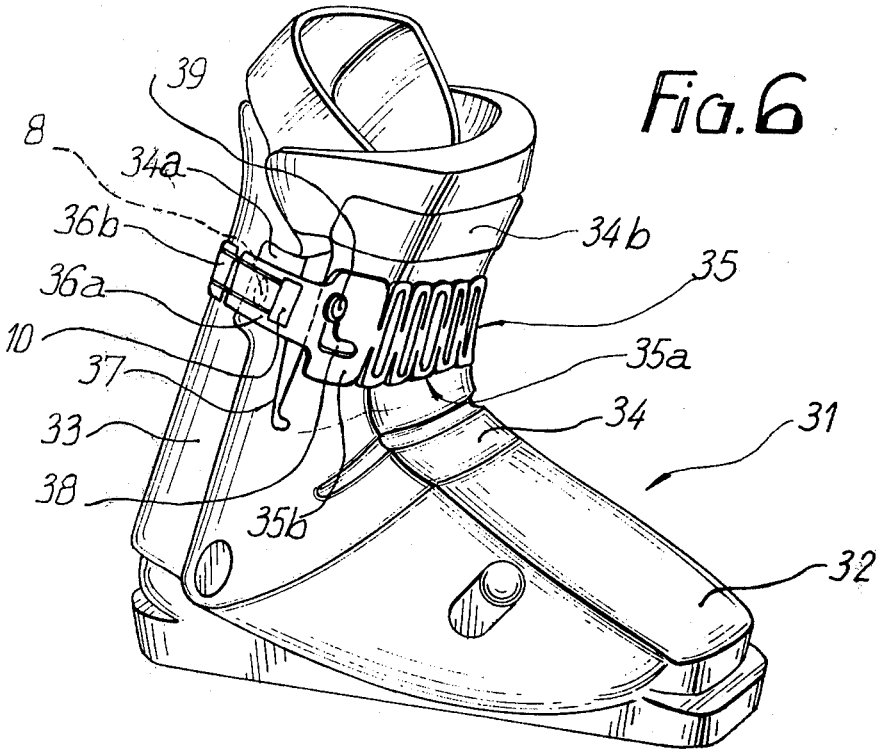
FIGS. 6 to 10 are views in perspective, in various positions of use, of a variant embodiment in which the deformable strap is anchored on the upper due to anchoring means fast with said upper.
Figure 7:
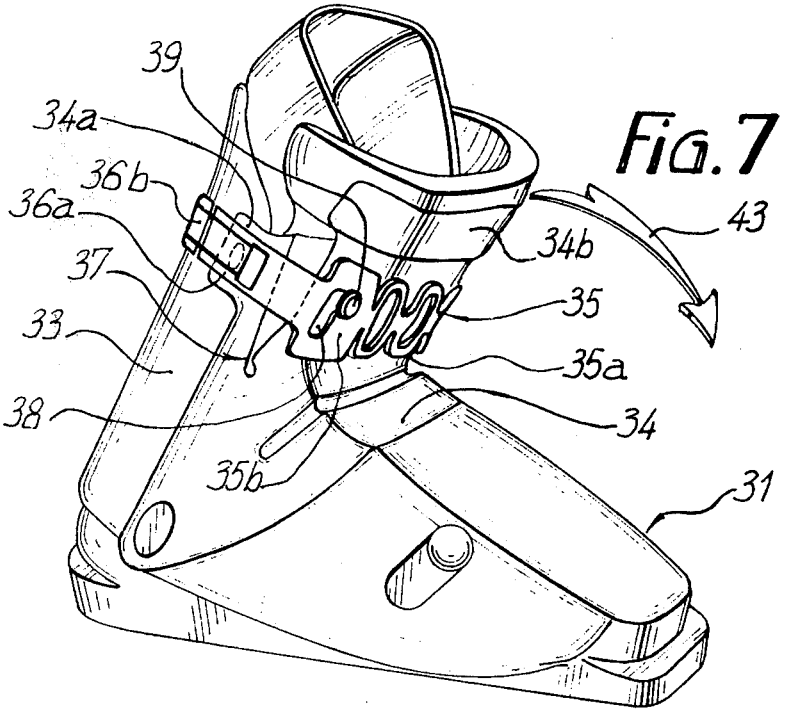

FIGS. 6 and 7 illustrate another embodiment according to the invention, showing respectively a boot in normal static position (FIG. 6) and in bent position (FIG. 7).

The functionning of this embodiment for controlling and regulating the forward flexion on a ski boot is similar to that described previously insofar as the upper 34, on which the deformable strap 35 is disposed, acts the same role of strap deformation limiter. To simplify the specification, only the portion of strap located on the front of the upper on this side of its means for anchoring on the upper, will be described. This strap 35 also comprises a frontal deformation zone 35 composed (in the case illustrated in FIG. 6 and 7) of oblong rings 41 connected together by connecting zones 40 located at the centres of the sides 42 of each of the adjacent rings.

The zone 35*a* presents, respectively on its two sides, two solid zones 35*b* extending rearwards by tongues 36a and 36b to surround the top of the upper. L-shaped slots or grooves 38 are arranged in zones 35*b*. These slots 38 are disposed symmetrically with respect to the vertical and longitudinal plane of symmetry of the boot, their respective arms 38*b* being oriented towards each other and their large arms 38*a* being respectively directed upwardly in the case of FIG. 6, substantially parallel to the axis of the upper. Two lugs 39 fast with the zone of flexion 34*b* of the upper 34 are respectively housed in the arms of the two L slots 38, and may easily slide therein under the effect of relative movements between the upper 34 and the strap 35. These lugs may for example each be provided with a head of which the diameter, slightly larger than the width of the groove, allows a locking of the lug in said latter.

Figure 8:
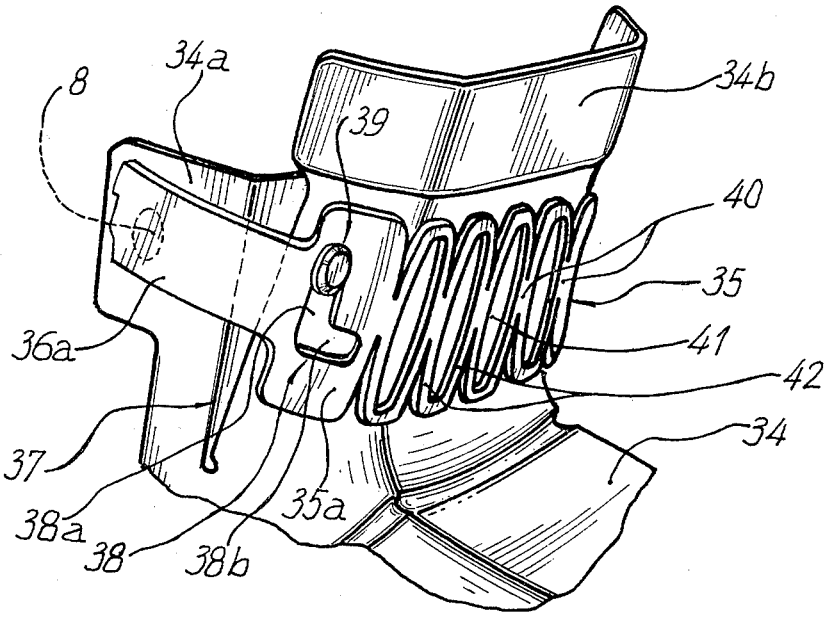

FIG. 8 shows more precisely the rigid position in which the upper 34 is established for the position of the strap 35 according to FIGS. 6 and 8 for which the lug 39 is housed in the top of the large arm 38*a* of the L-slot 38 consequently effecting a rigid assembly between the lateral rear parts 34*a* and the central flexion part 34*b* of the upper. This rigid assembly eliminates the effects of the slits 37 and ensures, as in the preceding case, a certain rigidity of the upper. This rigidity results from the fact that the central zone of flexion 34*b* being blocked on its two sides, it can be deformed only slightly (due to the nature of the relatively rigid material used), not influencing the zone of deformation 35*a* of the strap clearly more flexible than that of the upper due to the structure and/or nature of the material of said upper.

This first rigid position of use may then be modified by the user in order to obtain a more flexible upper progressively resisting the forward flexions of a skier's leg furnishing less pronounced efforts, but for which the upper may nevertheless bend.

Figure 9:
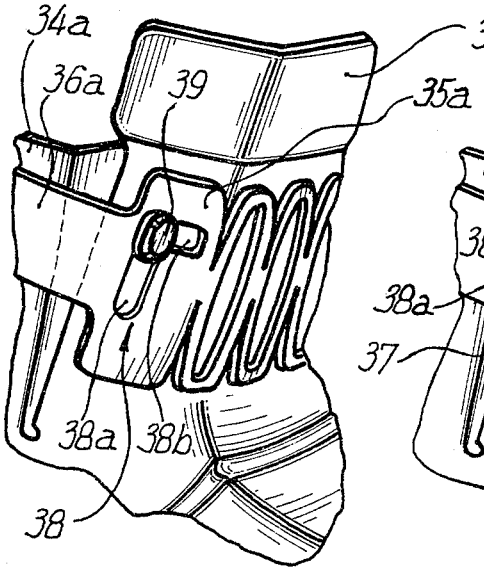

To this end, the skier inverts the straps, as described hereinbefore, and, for a normal static position, the lug 39 fast with each zone 34*b* is then located at the intersection, disposed uppermost of the large arm 38*a* oriented downwardly and of the small arm 38*b* oriented towards the longitudinal plane of symmetry of the boot (FIG. 9).

Figure 10:
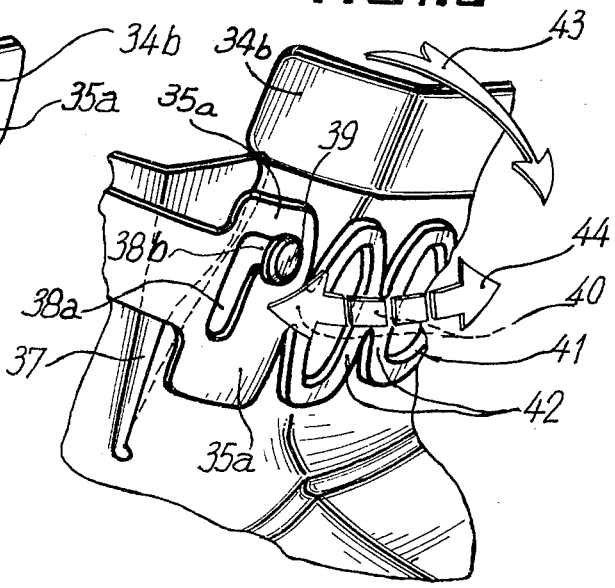

When a forward flexion is exerted by the skier in the direction of arrow 43 (FIG. 10), the zone 34*b* of the upper moves forwards and acts simultaneously at the level of the L-slot 38 in the small arm 38*b* in which the lug 39 moves. The forward flexion being continuous, the rings 41 move apart in the direction of double arrow 44 in broken lines enabling the zone 34*b* to advance and consequently the lug 39 to come into abutment at the end of the arm 38*b* of the slot 38, thus producing the extreme bent position for strap materials of mechanical characteristics determined for such a result.

According to a variant embodiment, the lateral stops may be constituted by two lugs fast with the strap 35, offset along an axis parallel to the longitudinal axis of this strap and located on either side of the zone of elastic deformation 35*a* of the strap, these lugs being housed in L-shaped slots made in the upper.

Figure 11:
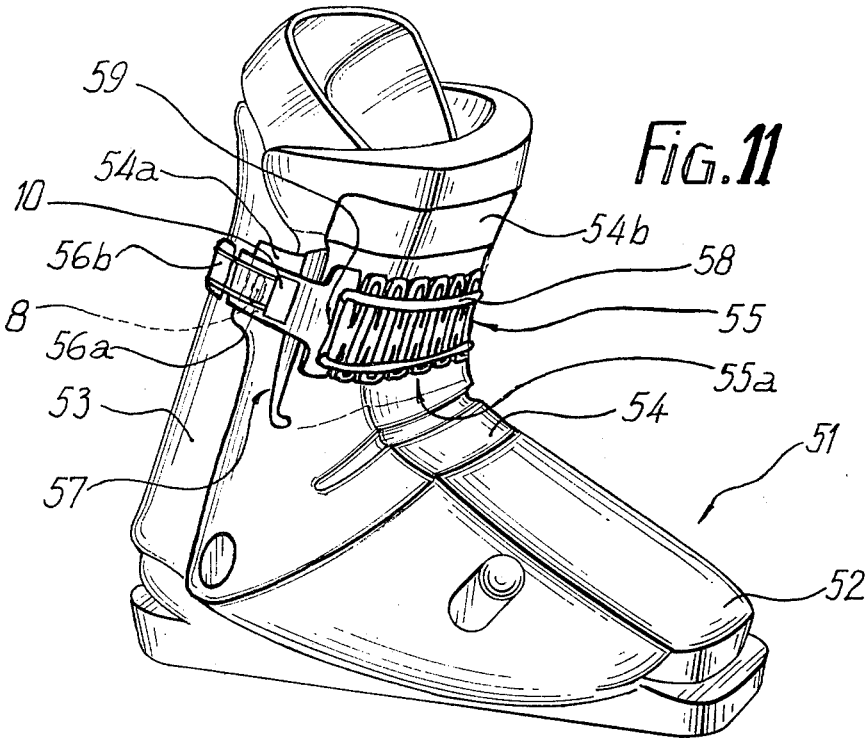
FIGS. 11 to 14 are views in perspective, in various positions of use, of another variant of ski boot in which the deformable strap comprises means for anchoring a stiffener element of which the rigidity of the material constituting it prevents the strap from being deformed and extending under the forces due to the front supports in the skier's leg.
Figure 12:
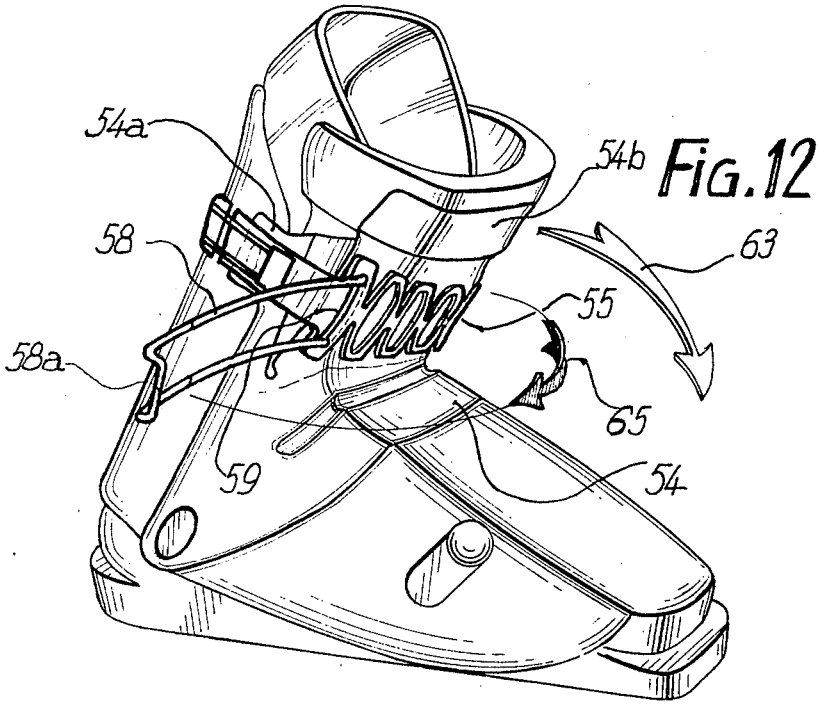

FIGS. 11 and 12 show another embodiment according to the invention, illustrating respectively a boot in normal static position (FIG. 11) and in forward flexion position (FIG. 12).

With this embodiment, the functionning remains similar to those described hereinbefore insofar as the elasticity and deformation of the strap 55 is controlled by a stiffener element 58 ensuring the same role of strap deformation limiter as the rigid support represented by the upper in the preceding cases.

Figure 13:
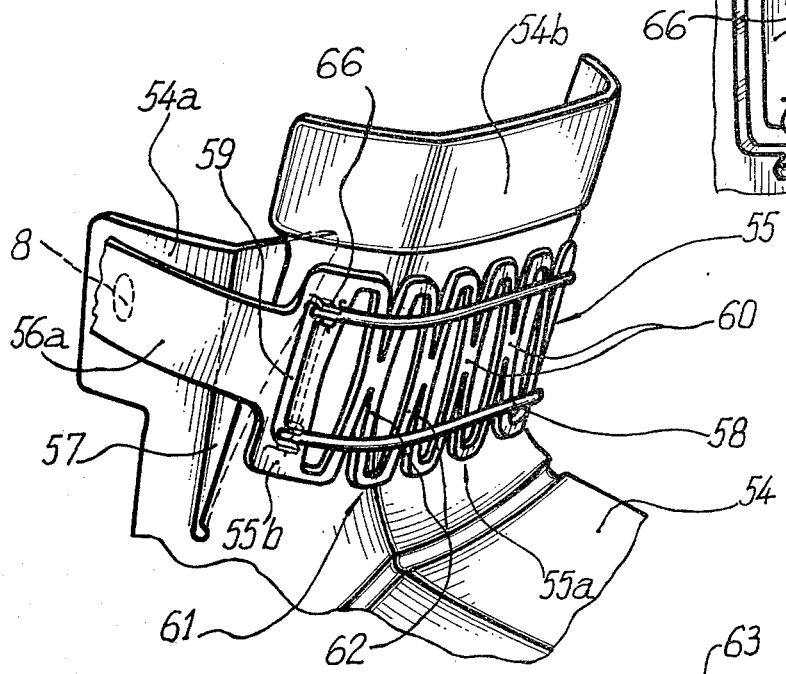

FIGS. 11 and 13 show a boot 51 in normal static position, the strap 55 being mounted on the rigid lateral rear parts 54*a* of the upper 54 due to fixing means 8 schematically shown in thin broken lines, located on a portion of strap 56*a* extending said strap rearwardly. The portion of strap 56*b*, coming from the other side of the strap 55, surrounds the top of the boot's upper and effects (due to closure means 10 which have been shown schematically) a relatively rigid assembly of the spoiler 53 with the rigid rear parts 54*a* of the upper.

The front part of the strap or zone of deformation 55*a* surrounds and covers the central zone of flexion 54*b* of the upper from the points of anchoring of the fixing means 8. In this embodiment, the rigid state of the upper is obtained by means of a stiffener element 58, advantageously made of a metallic cable for example, having a fairly considerable flexibility for a virtually zero property of extension, having regard to the efforts exerted by the skier. Of course, this stiffener 58 may be made of any other material and may be of different configurations, but it has the mechanical properties mentioned hereinabove.

Figure 15:
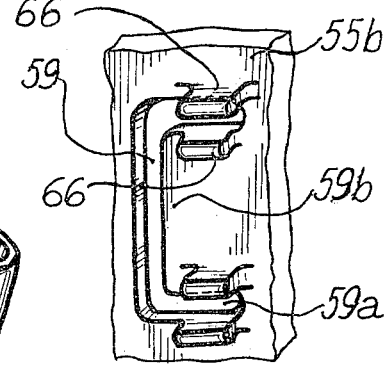
FIG. 15 is a view in perspective, on a larger scale, of the means for anchoring a type of stiffener element.

In the case of FIGS. 11 to 14, the stiffener 58 consists in a loop of rectangular form, of which the small sides 58*a* are engaged in substantially vertical slots 59 located in solid parts 55*b* of the strap 55 adjacent the zone of deformation 55*a* on each of its sides. Each of these slots (FIG. 15) extends, at the ends of its vertical part, by two horizontal slots 59*a* defining therebetween a zone 59*b* for anchoring the strap on which the end 58*a* of the stiffener 58 is hooked. To ensure a better position of the stiffener 58 on the strap 55, small guide studs 66 are provided, disposed on either side of each of the horizontal slots 59*a*. These guide studs may, moreover, be disposed, at least partially, on the perimeter of the zone of deformation. The stiffener 58 being anchored by its two ends 58*a* in the slots 59, it ensures the rigidity of the zone of deformation 55*a* of the strap by preventing any extension of the oblong rings 61 which compose it, as has already been described hereinbefore. Furthermore, the flexible position of the upper may be obtained by simply eliminating (indicated by the arrow of movement 65 in FIG. 12) the assembly of the stiffener 58 on the strap 55 by unhooking at least one of its ends 58*a* from the corresponding anchoring means 59*a*, the other end being able to remain permanently fixed on the anchoring means corresponding thereto.

Figure 14:
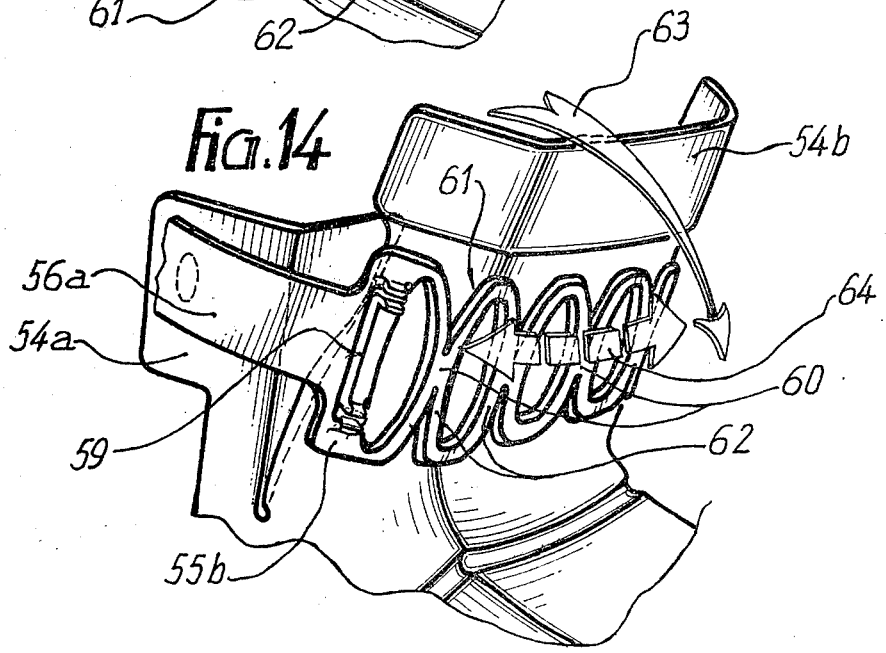

The stiffener being disconnected from the strap 55, said latter may then be deformed under the action of the efforts produced by the skier's leg upon forward flexion thereof (in the direction of arrow 63 of FIG. 12 and 14). The deformation is then effected at the level of the central zone 55*b* comprising a series of oblong rings 61 disposed vertically, and of which the spacing apart of the walls 62 in a transverse displacement (indicated by double arrow 64 of FIG. 14) brings about an extension of the length of the strap allowing an increase in the movement of the leg during said flexion. The progressiveness of the support in the present case, as in those set forth hereinbefore, is also obtained by the nature and characteristics of the material used for the strap, the flexibility of which is preferably greater than that of the upper.

The domain of the invention is not limited to the cases of the figures described. In particular, the oblong rings 17,41,61 used for the central deformation zones 5*b*, 35*b*, 55*b* may advantageously be replaced by any other shape or section which is deformable and which enables the strap to be extended.

Similarly, the means for controlling the deformation, recessed in the zone of flexion of the upper, may be in relief on the upper.

Furthermore, the means for controlling the deformation, made directly on the strap by means of an at least partially removable added piece, are not limited to the single version of the stiffener with cable, but may have any solid or perforated form made of rigid materials, fitting on said strap to prevent elongation therefore. The means of anchoring these different forms of stiffeners may also be recessed or in relief, on the strap.

FIGS. 16 to 20 show a variant embodiment of the ski boot illustrated in FIGS. 6 to 10. In this case, the upper 74 of the boot, which itself comprises lateral rear parts 74*a* and a central flexion part 74*b*, presents slots 78 in which are engaged lugs 79 carried by the deformable strap 75. The deformable strap 75 presents, respectively on its two sides, two whole zones 75*a* which carry the lugs 79 and which are rearwardly extended by tongues 76*a*, in order to surround the top of the upper. The two L-shaped slots 78 are respectively made in the two lateral parts of the central flexion part 74*b*, the horizontal arm of each L-shaped slot 78 extending rearwardly, whilst its vertical arms extends downwardly.

In FIG. 16, the boot is shown in the case of the strap 75 being placed in so-called "rigid" position. In this case, each lug 79 faces inwardly and is engaged in the end of the vertical arm of the associated slot 78.

In FIG. 17, the ski boot is shown in the case of the strap 75 being in controlled supple position for use. In this case, each lug 19 is located at the level of the horizontal arm of the associated slot 78, this allowing a certain forward movement of the central flexion part 74*b*, since each lug 79 may slide to a certain extend in said horizontal arm.

In FIGS. 18 and 19, the ski boot carries the strap 75 placed in total supple position of use. This position is obtained simply by turning the strap 75 over with respect to its horizontal axis, so that the two lugs 79 face outwardly and are therefore no longer engaged in the slots 78. The central flexion part 74*b* of the upper may then bend more forwardly as indicated by the arrow in FIG. 19.

Along these lines, and without departing from the scope of the invention, it is possible to combine these different forms of structures with each of the embodiments described.

What I claim is:

1. A ski boot comprising an upper whose stiffness is adjustable, an adjustable closure element surrounding said upper at least partially at the front portion thereof and in the zone corresponding to the lower leg and means for securing the adjustable closure element on the upper, wherein: the closure element comprises at least one zone of elastic deformation located between the means for securing on the upper, and means for controlling the deformation of said adjustable closure element cooperating with this latter at least on either side of said zone of deformation.

2. A ski boot as claimed in claim 1, wherein the adjustable closure element is a strap so constituted that its zone of elastic deformation extends under the effects of the efforts produced by movement of forward flexion of a skier's leg.

3. A ski boot as claimed in claim 1, wherein the zone of elastic deformation of the strap is constituted by a succession of juxtaposed and perforated sections, connected together along the longitudinal axis of said strap.

4. A ski boot as claimed in claim 3, wherein the perforated sections are constituted by oblong rings of which the large diameter is disposed vertically and which are each connected together by at least one zone of connection located substantially at the center of each of their adjacent sides.

5. A ski boot as claimed in claim 1, wherein the means for controlling the deformation are disposed between the strap and at least a part of the upper.

6. A ski boot as claimed in claim 1, comprising an upper composed of two parts, viz. a rear "spoiler" pivoted on a bottom part of the shell so as to allow the opening of the boot from the rear, and a front upper fast with the bottom part of the shell, surrounding the front of the bottom of the leg to absorb the efforts due to the movements of flexion of the skier, wherein the means for controlling the deformation of the strap are disposed and integrated with said upper, the zone of elastic deformation of the strap being fitted therebetween.

7. A ski boot as claimed in claim 6, wherein the means for controlling the deformation of the strap are constituted by two lateral stops separated from each other by a given constant length, and against which corresponding zones of support of the strap abut.

8. A ski boot as claimed in claim 7, wherein the lateral stops are materialized by the lateral edges of at least one recess made in the thickness of the upper transversely with respect to the longitudinal plane of symmetry of the boot.

9. A ski boot as claimed in claim 8, wherein the recess made in the thickness of the upper is of substantially rectangular shape, of length equal to the maximum length, in the non expanded state, of the zone of deformation of the corresponding strap.

10. A ski boot as claimed in claim 7, wherein the lateral stops are constituted by ribs or reliefs disposed laterally on each side of the upper parallel to the longitudinal plane of symmetry of the boot.

11. A ski boot as claimed in claim 10, wherein the ribs substantially define a rectangular recessed form a length equal to the maximum length, in the non expanded state, of the zone of deformation of the corresponding strap.

12. A ski boot as claimed in claim 7, wherein the zone of elastic deformation of the strap comprises longitudinal sides of different lengths in the non expanded state, the larger of these sides having a length substantially equal to the distance between the lateral stops.

13. A ski boot as claimed in claim 12, wherein for a rigid position of use of the upper, the part of the zone of deformation of which the length of the longitudinal side, in the non-expanded state, corresponding to the distance between the lateral stops, is placed towards the top of the upper, so that the two pieces coincide with each other, for this part of the strap.

14. A ski boot as claimed in claim 12, wherein for a flexible position of use of the upper, the part of the zone of deformation of which the length of the longitudinal side, in the non-expanded state, is shorter than the distance between the lateral stops, is placed towards the top of the upper so that, in normal static position, a clearance remains free each side of said zone of deformation and the lateral stops, and, upon forward flexions of the skier's leg, these clearances are absorbed by the zone of deformation elongating to abut against said lateral stops.

15. A ski boot as claimed in claim 7, wherein the lateral stops are materialized by lugs fast with the upper housed in L-shaped slots made in the strap.

16. A ski boot as claimed in claim 15, wherein for the rigid position of the upper, the L-shaped slots are disposed in the strap on either side of the zone of deformation, symmetrically with respect to the longitudinal plane of symmetry of the boot, the large arms of the L-slots being directed upwardly and the small arms being directed towards each other.

17. A ski boot as claimed in claim 16, wherein, for the flexible position of use of the upper, the L-slots are disposed in the strap on either side of the zone of deformation, symmetrically with respect to the longitudinal plane of symmetry of the boot, the large arms of the L-slots being oriented downwardly and the small arms being directed towards each other, so that, upon forward flexions of the skier's leg, the lugs slide horizontally in the small arms of the L-slots.

18. A ski boot as claimed in claim 7, wherein the lateral stops are constituted by two lugs fast with the strap, offset along an axis parallel to the longitudinal axis of said strap and located on either side of the zone of elastic deformation of the strap, these lugs being housed in the L-slots made in the upper.

19. A ski boot as claimed in claim 1, wherein the means for controlling the deformation of the strap are essentially disposed on said strap.

20. A ski boot as claimed in claim 19 comprising an upper composed of two parts, viz. a rear spoiler pivoted on a bottom part of the shell so as to allow the opening of the boot from the rear, and a front upper fast with said bottom part of the shell and surrounding the front of the bottom of the leg to absorb the efforts due to the movements of flexion of the skier, wherein the means for controlling the deformation of the strap are anchored on said latter in partly removable manner, the zone of deformation being maintained at a constant length by said means in the case of use with the upper in rigid position.

21. A ski boot as claimed in claim 20, wherein the means for controlling the deformation of the strap are constituted by at least one flexible but inextensible stiffener element fitted on the strap and hooking in the zones of anchoring made on either side of said zone of deformation of the strap.

22. A ski boot as claimed in claim 21, wherein the stiffener element is constituted by a metallic cable of which the two ends are rendered contiguous.

23. A ski boot as claimed in claim 21, wherein the anchoring zones are recessed in the strap.

24. A ski boot as claimed in claim 21, wherein the zones of anchoring are studs in relief on the strap.

25. A ski boot as claimed in claim 20, wherein, to obtain a flexible position of use of the upper, at least one of the ends of the stiffener element is disconnected from its corresponding zone of anchoring on the strap.

26. A ski boot as claimed in claim 6, wherein the means for controlling the deformation of the strap comprise lugs fast with the strap and L-shaped slots provided in the lateral parts of the upper, each of said L-shaped slots having a vertical arm running downwards and an horizontal arm running backwards, each of said lugs being engaged or not in an associated slot according to the position of the strap.

* * * * *